US006468060B1

(12) United States Patent
Dormer et al.

(10) Patent No.: US 6,468,060 B1
(45) Date of Patent: Oct. 22, 2002

(54) OIL FILM DILATION FOR COMPRESSOR SUCTION VALVE STRESS REDUCTION

(75) Inventors: Michael J. Dormer, Fabius, NY (US); Bruce A. Fraser, Manlius, NY (US); Wayne P. Beagle, Chittenango, NY (US); Peter F. Kaido, Verona, NY (US); Kyle D. Wessells, Syracuse, NY (US)

(73) Assignee: Carrier Corporation, Syracuse, NY (US)

( * ) Notice: Subject to any disclaimer, the term of this patent is extended or adjusted under 35 U.S.C. 154(b) by 419 days.

(21) Appl. No.: 09/032,971

(22) Filed: Mar. 2, 1998

(51) Int. Cl.[7] ..... F04B 39/10

(52) U.S. Cl. ..... 417/569; 137/246; 137/856; 251/355

(58) Field of Search ..... 417/432, 433, 417/569, 571; 137/246, 856, 246.12, 246.13; 251/355

(56) References Cited

U.S. PATENT DOCUMENTS

| | | | | |
|---|---|---|---|---|
| 1,583,535 A | * | 5/1926 | Dubrovin | 417/433 |
| 1,834,038 A | | 12/1931 | Summers | |
| 2,001,885 A | | 5/1935 | Ohmart | |
| 2,020,508 A | | 11/1935 | Knapp | |
| 2,110,107 A | | 3/1938 | Druodale | |
| 2,372,938 A | | 4/1945 | Doeg | |
| 2,981,462 A | | 4/1961 | Niedemayer | |
| 4,406,590 A | | 9/1983 | Kessler | |
| 4,522,568 A | | 6/1985 | Gelse et al. | |
| 4,580,604 A | * | 4/1986 | Kawaguchi et al. | 137/856 |
| 4,628,963 A | | 12/1986 | Ishijima et al. | 137/857 |
| 4,642,037 A | * | 2/1987 | Fritchman | 417/447 |
| 4,955,797 A | | 9/1990 | Cowen | |
| 5,035,050 A | | 7/1991 | Cowen | |
| 5,062,779 A | | 11/1991 | Da Costa | 137/356 |
| 5,203,686 A | | 4/1993 | Scheldorf et al. | |
| 5,452,994 A | | 9/1995 | Erickson | 417/550 |
| 5,609,476 A | | 3/1997 | Kim et al. | 417/447 |
| 5,806,336 A | * | 9/1998 | Sunaga et al. | 417/415 |
| 5,884,665 A | * | 3/1999 | Thurston et al. | 137/856 |

FOREIGN PATENT DOCUMENTS

| | | | |
|---|---|---|---|
| EP | 0 231 955 A2 | 5/1984 | 137/856 |
| JP | 60-7371 | 1/1985 | 137/856 |
| JP | 60-7372 | 1/1985 | 137/856 |
| JP | 2-26713 | 6/1990 | 137/856 |
| JP | 2-61631 | 12/1990 | |

* cited by examiner

*Primary Examiner*—Cheryl J. Tyler

(57) ABSTRACT

The seat of a suction valve of a reciprocating compressor is modified to limit the radial extent and thereby the area in which an annular oil film can be established between the valve and the valve seat. The preferred radial extent of the seating surface is 0.014 to 0.018 inches and the preferred ratio of the area of the suction valve seat to the passage therethrough is in the range of 13% to 25%.

7 Claims, 3 Drawing Sheets

OIL FILM DILATION FOR COMPRESSOR SUCTION VALVE STRESS REDUCTION

BACKGROUND OF THE INVENTION

In positive displacement compressors employing suction and discharge valves there are both similarities and differences between the two types of valves. Normally the valves would be of the same general type. Each valve would be normally closed and would open due to a pressure differential across the valve in the direction of opening. The valve may be of a spring material and provide its own seating bias or separate springs may be employed. Since the suction valve(s) open into the compression chamber/cylinder they generally do not have valve backers in order to minimize the clearance volume and thus deflection of the valve is not physically limited. Discharge valves normally have some sort of valve backer so as to avoid excess movement/flexure of the discharge valve. Ignoring the effects of leakage, etc., an equal mass of gas is drawn into the compression chamber and discharged therefrom. However, the suction stroke takes place over, nominally, a half cycle whereas the compression and discharge strokes together make up, nominally, a half cycle. In the case of the suction stroke, the suction valve opens as soon as the pressure differential across the suction valve can cause it to unseat. Typically, the pressure differential required to open the suction valve is on the order of 15–35% of the nominal suction pressure. In the case of the compression stroke, compression continues with the attendant reduction in volume/increase in density of the gas being compressed until the pressure of the compressed gas is sufficient to overcome the combined system pressure acting on the discharge valve together with spring bias of the valve member and/or separate springs. Typically, the pressure differential required to open the discharge valve is on the order of 20–40% of the nominal discharge pressure. Accordingly, the mass flow rate is much greater during the discharge stroke.

By design, suction valves have a much lower seating bias than discharge valves. The low seating bias is essential due to the fact that valve actuation is initiated by the force resulting from the pressure differential across the valve. In the case of suction valves, opening generally occurs at pressures that are much lower than in the case of discharge valves. Therefore, only small pressure differences, and hence small opening forces, can be created for suction valves relative to potential pressure differences and opening forces for discharge valves. Even a small increase in the pressure differential across the suction valve results in a large percentage increase in the pressure differential across the valve. In contrast, an equal increase in the pressure differential across the discharge valve results in a much smaller percentage increase in the pressure differential because of the substantially higher nominal operating pressure.

The opening force, F, on a valve is given by the equation $$F=P\cdot A$$

where P is the pressure differential across the valve and A is the valve area upon which P acts. It should be noted that the direction in which the pressure differential acts changes during a complete cycle so that during a portion of a cycle the pressure differential provides a valve seating bias. When A is held constant, it is clear that a change in F is proportional to a change in P, or, more specifically, the percentage change in F is proportional to the percentage change in P. For example, assuming an operating condition where suction pressure is 20 psia and discharge pressure is 300 psia, at a typical overpressure value of 35% the cylinder will rise to 405 psia before the discharge valve opens. In contrast, at a typical underpressure value of 30%, the cylinder pressure will drop to 14 psia, before the suction valve opens. If the pressure differential required to open both valves is increased by 10 psia, the discharge overpressure value increases to 38% from 35% while the suction underpressure value increases to 80% from 30%. Thus, we can expect the opening force on the suction valve to increase 167%.

Particularly because of the effects of the clearance volume, the change in pressure differential across the suction valve would not increase very rapidly since the device is initially charged due to the compressed gas from the clearance volume and is then acting as a vacuum pump until the suction valve opens. Specifically, the inflow of gas to the cylinder is typically designed to occur during the last 95% of the combined expansion and suction stroke. In contrast, the compression chamber pressure rises rapidly as the compression stroke is being completed and the pressure can continue to rise during the discharge stroke if the volume flow exiting the cylinder does not match the rate of reduction in the compression chamber volume. Typically, the outflow of gas from the cylinder occurs during the last 40% of the combined compression and discharge strokes. Any substantial change in one or more of these relationships can result in operational problems relative to the valves.

Another complicating factor arises from the fact that under typical operating conditions, lubricating fluid (oil) coats all internal surfaces of a compressor, including the suction and discharge valves and valve seats. The associated problems as to improving discharge efficiency as related to the discharge valve have been addressed in U.S. Pat. No. 4,580,604. In the case of a discharge valve, the cylinder pressure must overcome the system pressure acting on the discharge valve, the spring bias on the valve and any adhesion of the valve to the seat. Accordingly, the adhesion of the discharge valve to the seat represents an over pressure and therefore an efficiency loss.

SUMMARY OF THE INVENTION

A typical reciprocating compressor will have a valve plate with an integral suction port and suction valve seat. When in the closed position, the film of oil present between the suction valve and its seat is very thin, on the order of a few molecular diameters. This is in part due to the fact that compression chamber pressure acts on and provides a seating bias for the suction valve during the compression and discharge strokes. In normal operation, the opening force applied to the suction valve is provided by a pressure differential across the valve that is created as the piston moves away from the valve during the suction stroke. Typically, the opening force needs to be large enough to overcome the resistance to opening caused by valve mass (inertia) and any spring or other biasing forces. The force also needs to be substantial enough to dilate and shear the oil film trapped between the valve and seat. Factors that influence the force necessary to dilate and shear the lubricant film include: the viscosity of the lubricant film, the thickness of the oil film, the inter-molecular attractive forces between the lubricant molecules, the materials of construction of the suction valve and/or valve seat, and the rate of refrigerant outgassing.

In traditional refrigerant-compressor applications using mineral-based (MO) or alkylbenzene (AB) lubricants, the resistance to opening caused by the lubricants is negligible as indicated by the relatively small pressure differential that is required to initiate valve opening. This is due, in large part, to the fact that MO and AB lubricants exhibit relatively low viscosity, low inter-molecular forces and good solubility with refrigerants over the entire range of operating conditions.

Newer, ozone-friendly refrigerant-compressor applications utilize polyol ester (POE) lubricants. When compared to MO or AB lubricants, POE lubricants can exhibit extremely high lubricant viscosity and poor solubility with HFC refrigerants such as R134a, R404A, and R507, particularly under low operating pressures and/or temperatures. The relatively high viscosity of POE's can cause a substantial increase in the force necessary to dilate and shear the oil film trapped between the valve and seat. Additionally, POE lubricants are very polar materials and hence have a strong molecular attraction to the polar, iron-based materials that are typically used to manufacture valves and valve seats. The mutual attraction of the materials of construction and the POE further increases the force necessary to separate the valve from the valve seat.

In order to generate the increase in force needed to separate the suction valve from its valve seat, the pressure differential across the valve must be increased with an accompanying delay in the valve opening time. When the suction valve does finally open, it does so at a very high velocity. Further, aggravating this condition is the increase in the volume flow rate of the suction gas entering the cylinder resulting from the delay in the suction valve opening. The increase in the volume flow rate of the suction gas causes an increase in suction gas velocity which, in turn, increases the opening force applied to the suction valve and, hence, the velocity at which the valve opens. The increased suction valve opening velocity resulting from the combined effects of a higher pressure differential on the valve due to the delayed opening and the higher volumetric flow rate of the flow impinging upon the suction valve causes the suction valve to deflect further than intended into the cylinder bore. Without the benefit of a valve backer, as would be present in a discharge valve, valve operating stress must increase as a result of the increase in valve deflection. If the operating stress exceeds the apparent fatigue strength of the valve, then valve failure will occur.

The present invention reduces the pressure force required to open the suction valve by promoting dilation of the oil film trapped between the suction valve and the valve seat. In this fashion, subsequent problems associated with high valve velocity, high volume flow rate, high suction gas velocity, and high valve stress are avoided. In effect, by reducing the contact area between the valve and the valve seat, a beneficial reduction in the pressure force required to open the valve can be attained, along with a subsequent reduction in operating stress.

The radial extent or width (w) of the suction valve seat must be carefully controlled to a specific range of values which provides a ratio of the valve seat area to the valve port area in the range of 3% to 33% with the preferred range being 13% to 25%. The actual radial extent of the suction valve seat is preferably in the range of 0.014 to 0.018 inches, with 0.02 inches being a maximum acceptable width. This range represents a compromise between the readily worn, minimum adhesion of a knife edge seat and the increased durability and adhesion with increasing width. Essentially, the suction valve seat is an annular, thin-walled cylindrical portion extending from the valve plate.

It is an object of this invention to reduce suction valve adhesion to the valve seat.

It is an additional object of this invention to reduce operating stress on a suction valve.

It is another object of this invention to facilitate the release of the suction valve from the valve seat earlier in the suction stroke. These objects, and others as will become apparent hereinafter, are accomplished by the present invention.

Basically, the valve seat of a suction valve is configured to reduce the contact area and associated oil film between the valve and valve seat.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENTS

Figure 1:
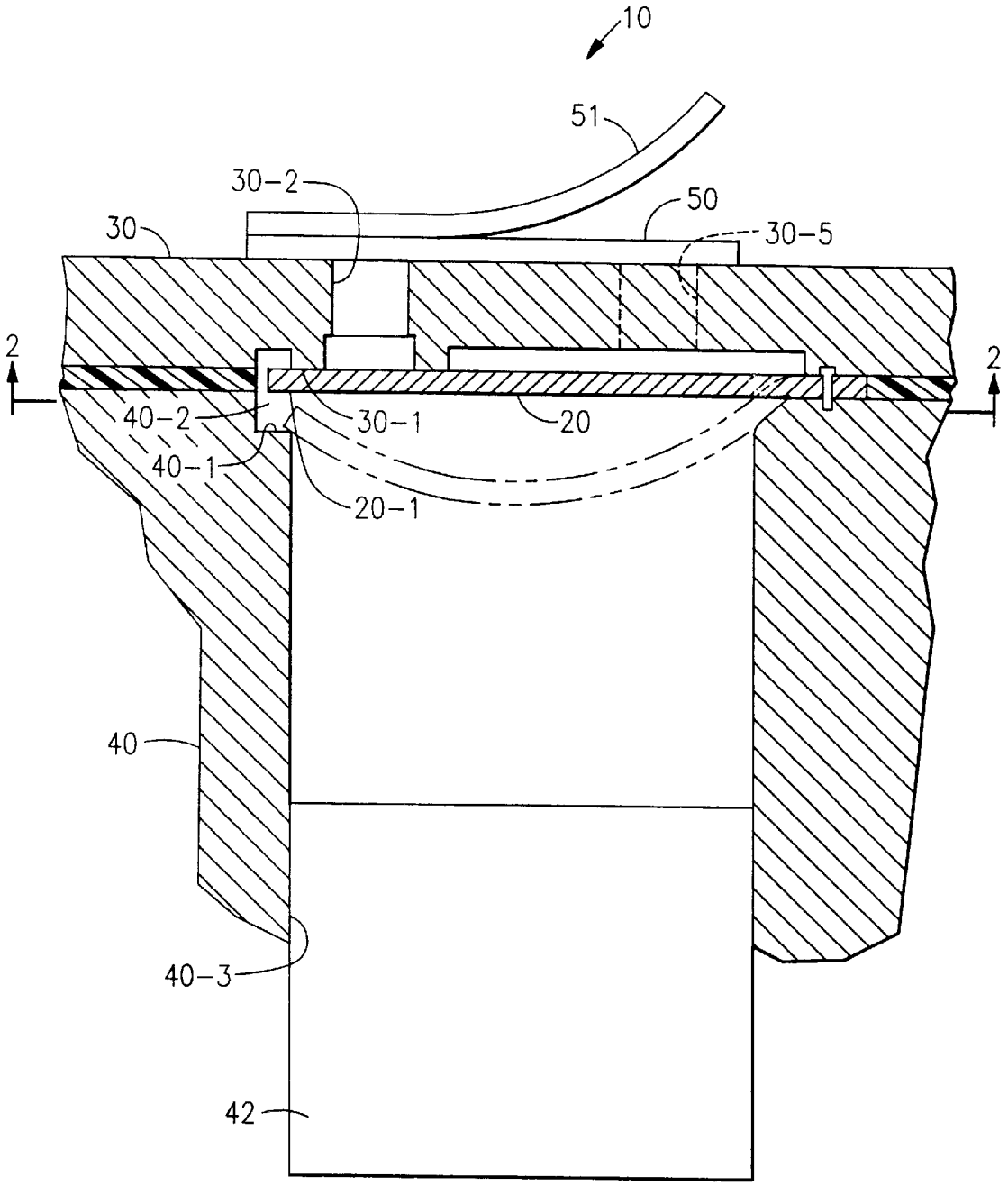
FIG. 1 is a sectional view of a portion of a reciprocating compressor employing the present invention.
Figure 2:
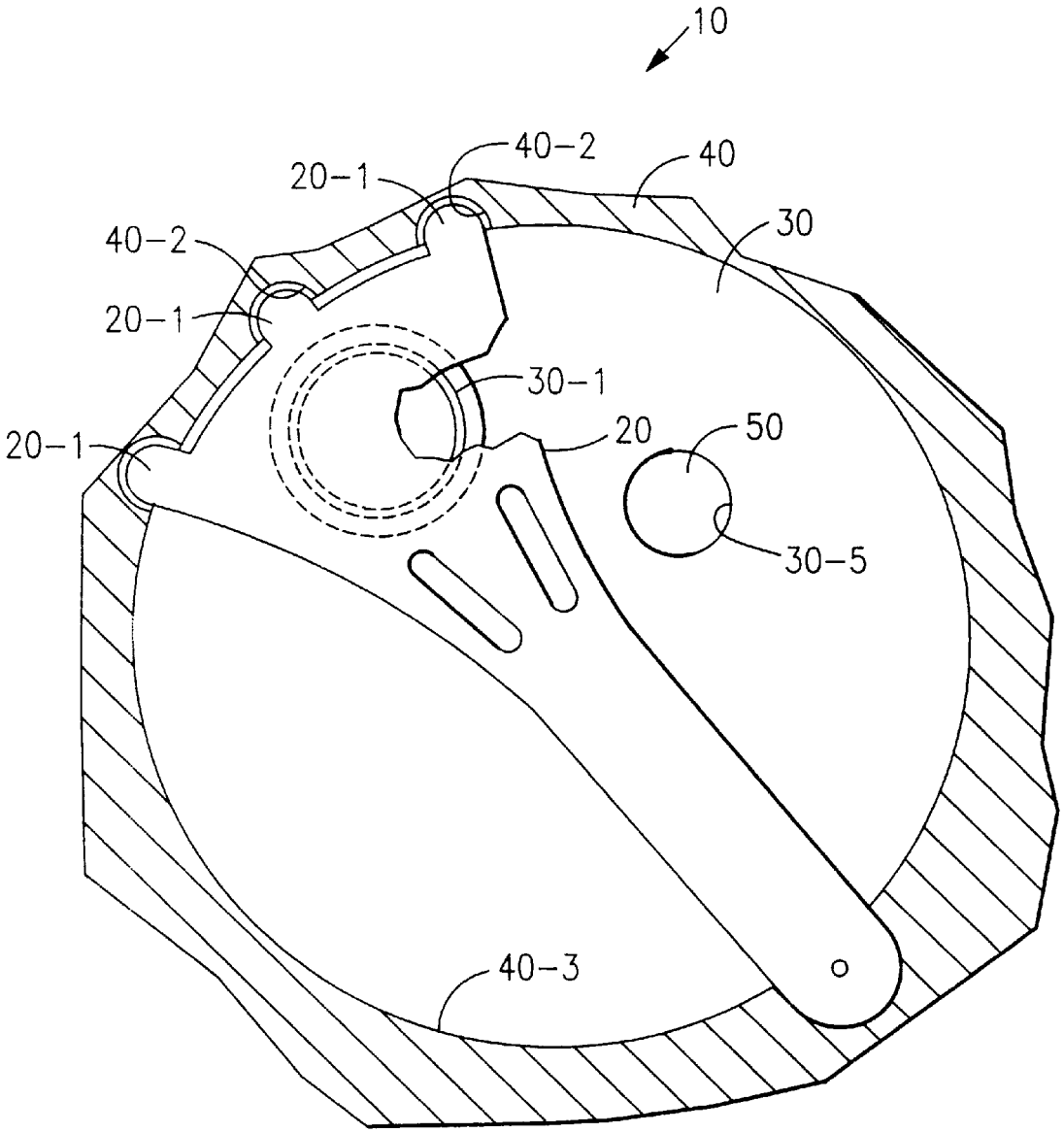
FIG. 2 is a partially cutaway view taken along section 2—2 of FIG. 1.

In FIGS. 1 and 2, the numeral 10 generally designates a reciprocating compressor. As, is conventional, compressor 10 has a suction valve 20 and a discharge valve 50, which are illustrated as reed valves, as well as a piston 42 which is located in bore 40-3. Discharge valve 50 has a backer 51 which limits the movement of valve 50 and is normally configured to dissipate the opening force applied to valve 50 via discharge passage 30-5 over its entire opening movement. In the case of suction valve 20, its tips 20-1 engage ledges 40-1 in recesses 40-2 in crankcase 40 which act as valve stops. Ledges 40-1 are engaged after an opening movement on the order of 0.1 inches, in order to minimize the clearance volume, with further opening movement by flexure of valve 20 as shown in phantom in FIG. 1. Specifically, initial movement of valve 20 is as a cantilevered beam until tips 20-1 engage ledges 40-1 and then flexure is in the form of a beam supported at both ends. As shown in phantom in FIG. 1, valve 20 moves into bore 40-3.

As discussed above, the POE lubricants tend to cause adhesion between valve 20 and seat 30-1 formed in valve plate 30. Absent the adhesion reduction of the present invention, valve 20 would open at a higher differential pressure and tend to strike ledges or stops 40-1 at a higher velocity such as to facilitate flexure into bore 40-3 which, when coupled with the impinging flow from suction passage 30-2 can cause flexure of valve 20 beyond its yield strength and/or drive valve so far into bore 40-3 that tips 20-1 slip off of ledge or stops 40-1.

Figure 3:
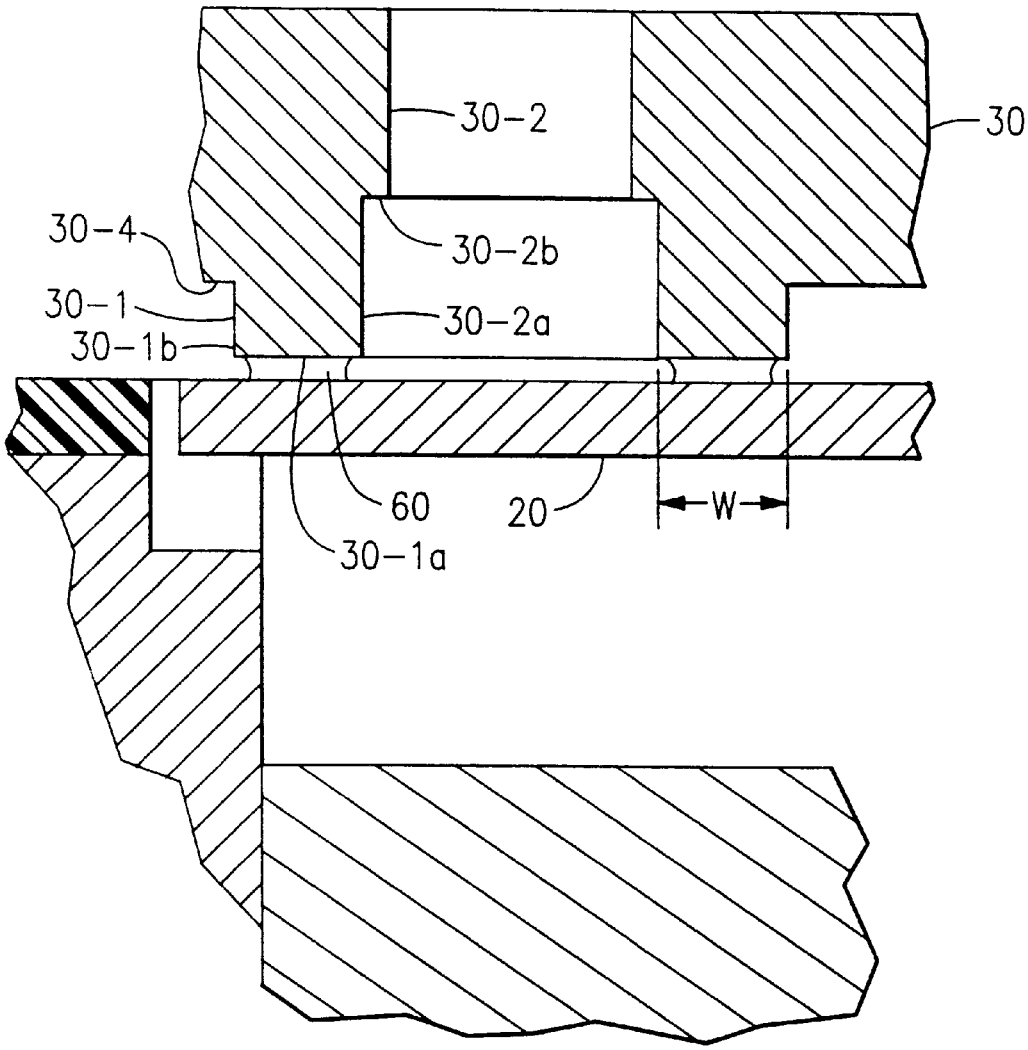
FIG. 3 is a sectional view of a portion of FIG. 1 showing the suction valve structure.

Turning now to FIG. 3, it will be noted that seat 30-1 is essentially a thin-walled cylinder having a flat, annular seating surface 30-1*a* having a ratio of the valve seat area to the valve port area in the range of 3% to 33% with the preferred range being 13% to 25%. Additionally, the preferred radial extent or width, w, of seating surface 30-1*a* is 0.014 to 0.018 inches. To help maintain the desired width, precision counterbore 30-2*a* is provided and separated from the seat of suction passage 30-2 by shoulder 30-2*b*. The outer cylindrical surface 30-1*b* of seat 30-1 is precision machined relative to precision counterbore 30-2*a* to permit the maintaining of the tolerances of the radial width w of seating surface 30-1*a*. The shoulder 30-4 defining the end of surface 30-1*b* and shoulder 30-2*b* can be normal to seating surface 30-1*a*, thus simplifying the manufacturing process. It is also acceptable, and perhaps desirable, to have a chamfer or edge break at the transitions defined by the shoulders. This chamfer may eliminate the generation of burrs during manufacturing and may facilitate the shearing of the oil film trapped between valve 50 and seating surface 30-1*a*.

The main consideration is to limit the location and thereby the width of oil film 60. Specifically, limiting the portion of seat 30-1 touching or in close proximity with valve 20 so as to maintain an oil film 60 therebetween. As should be obvious, the smaller the oil film, the more easily it is ruptured with the consequence of opening earlier in the suction stroke at a lower differential pressure a less violent opening and slower flow.

Although a preferred embodiment of the present invention has been illustrated and described, other changes will occur to those skilled in the art. It is therefore intended that the scope of the present invention is to be limited only by the scope of the appended claims.

What is claimed is:

1. In a reciprocating compressor having a cylinder with a piston therein, a suction valve and a valve plate with an integral suction valve seat and lubricated by an oil which forms an oil film between said suction valve and said valve seat with at least a portion of said oil film being no more than a few molecular diameters thick the improvement comprising:

said seat extending towards said piston and forming an annular surrounding wall which is an extension of a suction passage and which has an annular seating surface having a radial extent no greater than 0.02 inches.

2. The improvement of claim 1 wherein HFC refrigerant is being compressed by said compressor.

3. The improvement of claim 2 wherein the HFC refrigerant is one of R134a, R404A and R507.

4. The improvement of claim 1 wherein the ratio of the area of said suction valve seat to said extension of the suction passage is in the range of 3% to 33%.

5. In a reciprocating compressor having a cylinder with a piston therein, a suction valve and a valve plate with an integral suction valve seat and lubricated by an oil which forms an oil film between said suction valve and said valve seat with at least a portion of said oil film being no more than a few molecular diameters thick the improvement comprising:

said seat extending towards said piston and forming an annular surrounding wall which is an extension of a suction passage and wherein the ratio of the area of said suction valve seat to said extension of the suction passage is in the range of 3% to 33%.

6. The improvement of claim 5 wherein HFC refrigerant is being compressed by said compressor.

7. The improvement of claim 6 wherein the HFC refrigerant is one of R134a, R404A and R507.

* * * * *